US005667016A

United States Patent [19]

Henderson et al.

[11] Patent Number: 5,667,016

[45] Date of Patent: Sep. 16, 1997

[54] PACKER WITH BACK-UP RETRIEVING METHOD

[75] Inventors: William D. Henderson, League City; Jeffrey J. Lembcke, Houston, both of Tex.

[73] Assignee: Baker Hughes Incorporated, Houston, Tex.

[21] Appl. No.: 585,214

[22] Filed: Jan. 11, 1996

[51] Int. Cl.[6] ..... E21B 23/06; E21B 33/129

[52] U.S. Cl. ..... 166/387; 166/123

[58] Field of Search ..... 166/123, 124, 166/125, 387

[56] References Cited

U.S. PATENT DOCUMENTS 3,749,166 7/1973 Young ..... 166/123

5,086,839 2/1992 Setterberg, Jr. et al. ..... 166/138

5,273,109 12/1993 Arizmendi et al. ..... 166/123

*Primary Examiner*—David J. Bagnell

*Attorney, Agent, or Firm*—Rosenblatt & Redano P.C.

[57] ABSTRACT

A packer or bridge plug is described which may be released by manipulation of the production tubing connected to it. If manipulation of the production tubing is unsuccessful in releasing the packer, the tensile strength of the production tubing need not be exceeded in attempting to remove the packer. Instead, the production tubing is removed along with certain internal components of the packer. Thereafter, heavy-wall tubing, with or without jars, can be lowered into the wellbore with a retrieving tool at the bottom of that string. The retrieving tool latches onto components of the packer to allow an alternative method of release which allows for use of significantly higher tensile loads to liberate the packer from the wellbore.

17 Claims, 7 Drawing Sheets

PACKER WITH BACK-UP RETRIEVING METHOD

FIELD OF THE INVENTION

The field of this invention relates to retrievable packers, and more particularly to packers that may be retrieved in more than one way.

BACKGROUND OF THE INVENTION

Packers are frequently used in oil and gas production to isolate one portion of a wellbore from another. After being set in a wellbore for what could be as long as many years, these packers need to be retrieved. Several designs have been incorporated in the past for retrievable packers. One such packer, known as a seal-bore-type, packer was run in on wireline. After setting the packer on wireline, tubing was run and connected to the packer by means of an anchor. In order to retrieve this type of packer, the production tubing had to be disconnected from the packer and removed from the wellbore. A separate trip into the wellbore was then required with a specially designed retrieving tool that released the mechanisms within the packer to allow it to be unset and retrieved. Since the additional run of tubing was made with heavyweight drillpipe with or without jars, which allowed for tensile loads higher than the standard production tubing, these types of packers were often used and easily retrieved. Often these packers, after remaining in the wellbore for many years, required the additional tensile loads that could be applied through the heavy-wall tubing in combination with jars. These high-tensile loads were necessary due to parts corroding together or debris settling out around the packer. While this type of design allowed for retrieval, it was only at the expense of running the heavy-wall tubing into the hole on a separate run. Typical of such packers are packers made by Baker Oil Tools under Product No. 646, also called RETRIEVA-D; RETRIEVA-DB; and RETRIEVA-DAB LOCK-SET retrievable packers.

Another type of packer previously used is referred to as a modified tubing-set packer. This particular type of packer could be set on a wireline. Part of the assembly of the packer included a seal nipple and an on/off tool. These components were connected to the packer mandrel above the packer and were left in the well when the packer was set. The production tubing was then run in and engaged with the on/off tool seal nipple. The packer was retrieved by manipulating the tubing in combination with rotation and tension to release the packer. The packer was then retrieved on the production tubing. While this technique was desirable because it did not require an additional tubing run, as indicated with the previously described seal-bore-type packers, such packers have been found to be less reliable when it comes to retrieval than the seal-bore packers, primarily due to the tensile limits of the production tubing string, the on/off tool, and the packer mandrel. Typical of such assemblies of the modified tubing-set packer are a wireline-set Uni-Packer VI made by Guiberson.AVA, a division of Dresser Industries. Nipples which convert permanent or retrievable packers into temporary bridge plugs and which are carried in with the packer when it is set are known in the art and one such product is made by Baker Oil Tools, Model RS, Product No. 66548 Setting Nipple.

Accordingly, an objective of the present invention is to provide a packer or bridge plug which can be tubing-released but if such mode of release for any reason does not function to release the packer or bridge plug, a back-up method of release with a releasing tool is also available for the same packer. The alternative method of release functions akin to the operation of the seal-bore-type packers and requires the additional run into the wellbore with heavy-wall tubing to be used. Accordingly, the objective of the invention is to give a greater confidence level to operators beyond that previously experienced with using only a modified tubing-set packer. Now, with the present invention, if the modified tubing-set packer with the production tubing string fails to release, an alternative release mechanism is available.

SUMMARY OF THE INVENTION

A packer or bridge plug is described which may be released by manipulation of the production tubing connected to it. If manipulation of the production tubing is unsuccessful in releasing the packer, the tensile strength of the production tubing need not be exceeded in attempting to remove the packer. Instead, the production tubing is removed along with certain internal components of the packer. Thereafter, heavy-wall tubing, with or without jars, can be lowered into the wellbore with a retrieving tool at the bottom of that string. The retrieving tool latches onto components of the packer to allow an alternative method of release which allows for use of significantly higher tensile loads to liberate the packer from the wellbore.

DETAILED DESCRIPTION OF THE DRAWINGS

FIGS. 1*a*–1*d* illustrate the packer of the present invention in the run-in position.

FIGS. 2*a*–2*d* illustrate the packer in the set position.

Figure 1A:
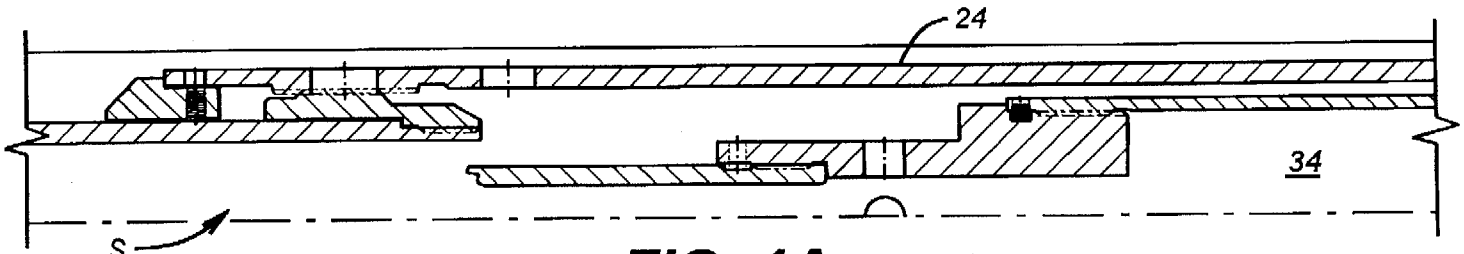
Figure 1B:
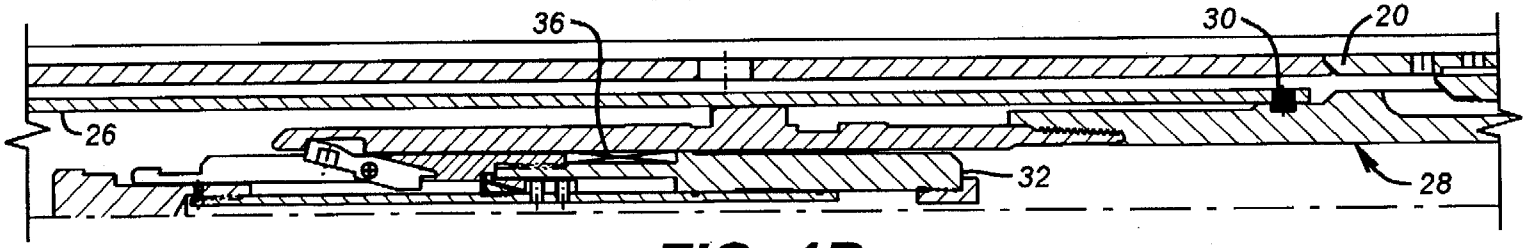
Figure 1C:
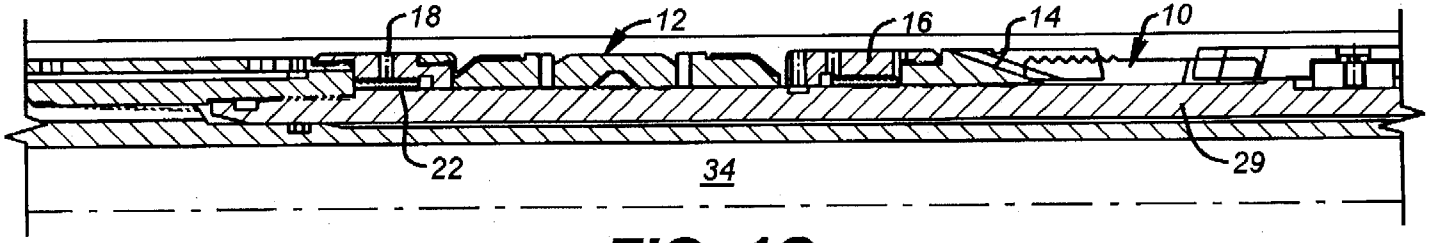
Figure 1D:
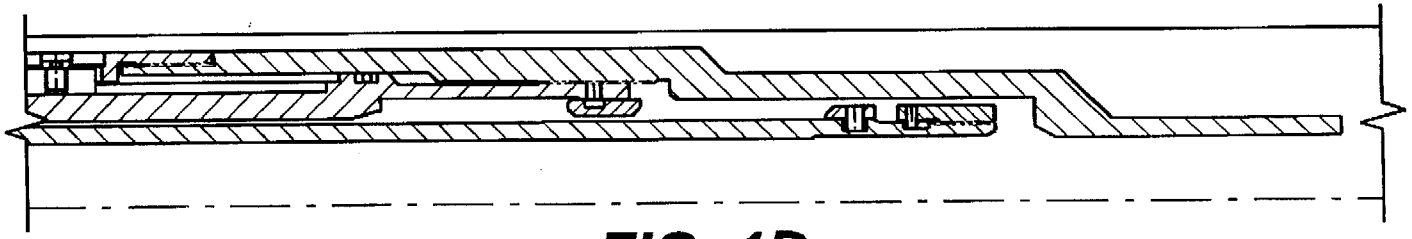
Figure 2A:
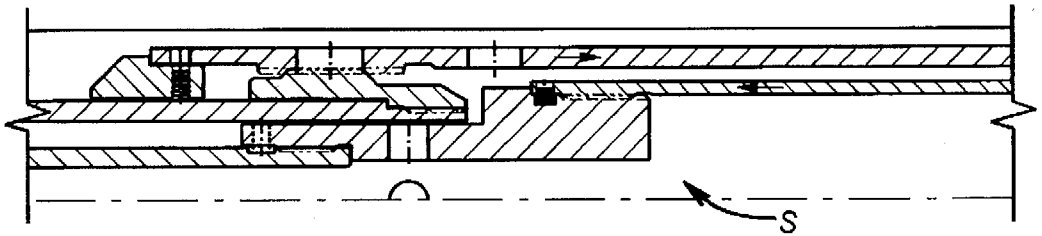
Figure 2B:
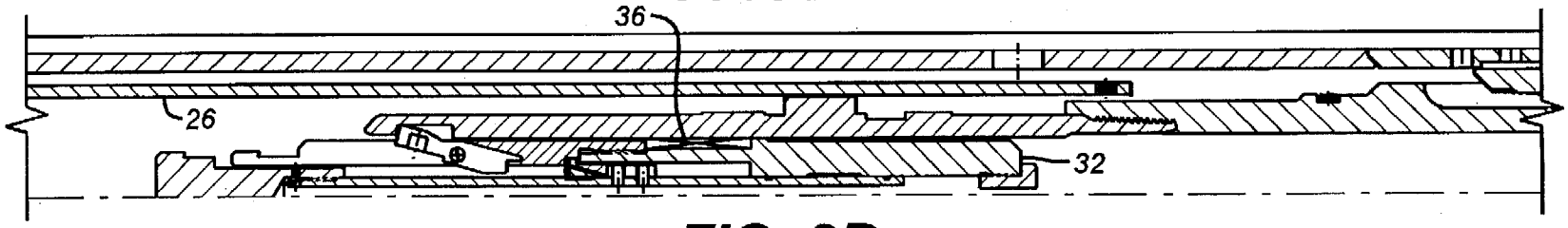
Figure 2C:
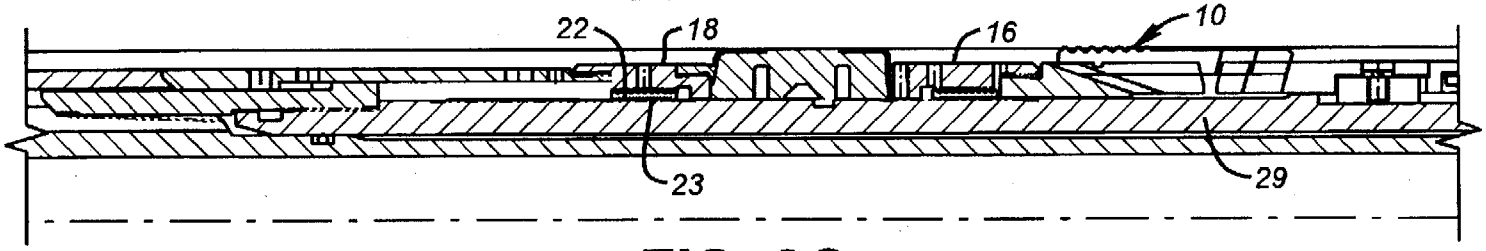
Figure 2D:
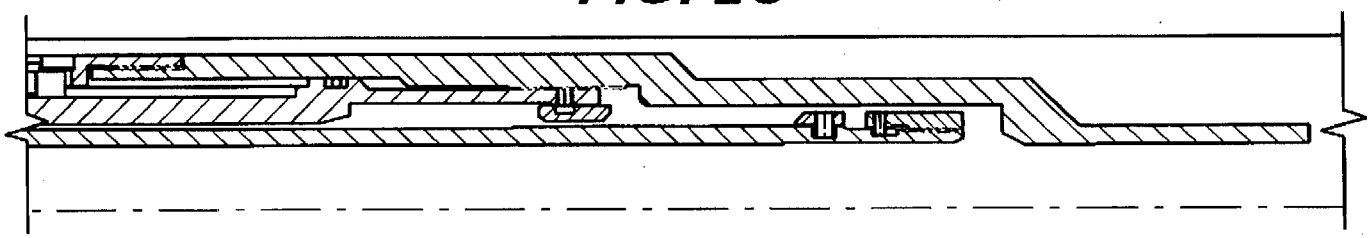
Figure 3A:
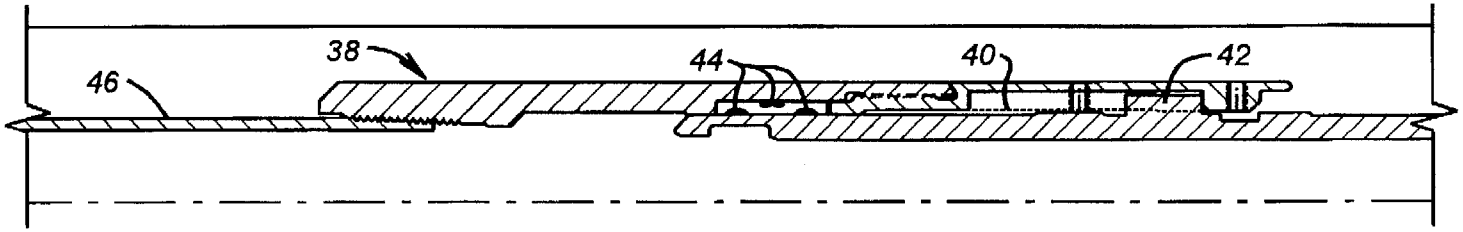
Figure 3B:
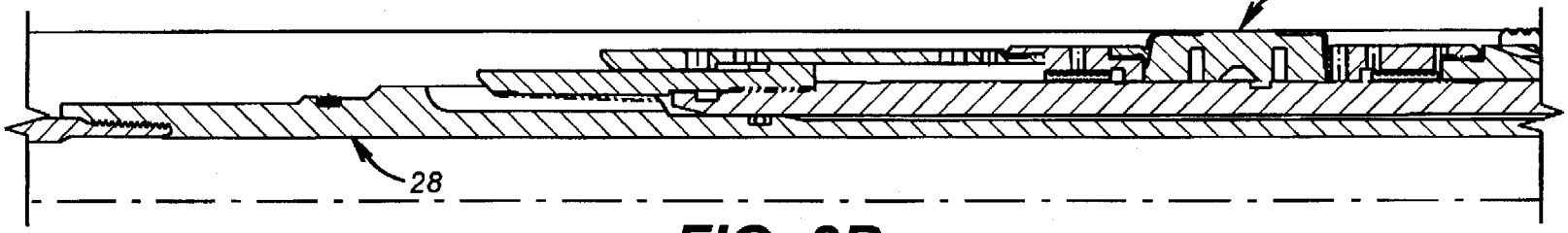

FIGS. 3*a*–2*d* illustrate the packer in the set position with the washover shoe of the on/off tool latched into a J-slot.

FIGS. 4*a*–4*d* illustrate the fully retrieved position using the washover shoe of the on/off tool latched into the J-slot.

FIGS. 5*a*–5*d* illustrate the tool in the set position after rotation off of the lower end of the mandrel.

FIGS. 6*a*–6*d* are similar to the view of 5*a*–5*d* except showing the mandrel sheared.

FIGS. 7*a*–7*d* show the alternative retrieval using a retrieving tool.

DETAILED DESCRIPTION OF THE PREFERRED EMBODIMENT

Referring to FIGS. 1*a*–*d*, the apparatus of the present invention is illustrated. Since many of the features of the packer are standard components, they will be described only very briefly. Packers or bridge plugs generally have a series of slips 10 and sealing elements 12. The slips 10 anchor the packer, while the sealing elements 12 seal off around the periphery. The slips 10 are cammed outwardly along tapered surfaces 14, while the sealing elements 12 expand radially outwardly by becoming compressed between rings 16 and 18. Ring 18 is connected to a setting sleeve 20. A setting tool S of the type well-known in the art has components that move in opposite directions to create the necessary relative movement to urge the slips 10 along the tapered surfaces 14, followed by the setting of the sealing elements 12 as rings 16 and 18 approach each other. A lock ring 22 holds the set of the sealing elements 12 after compression has occurred, as seen by comparing FIG. 1*c* to FIG. 2*c*. The setting tool S has a downwardly moving sleeve 24, which bears on setting sleeve 20 but is otherwise not physically connected thereto. Another portion of the setting tool S includes a sleeve 26 which is secured to a mandrel 28 by a shear pin 30. Supported by mandrel 28 is a known blanking plug 32 which is run in with the entire assembly so as to seal off an internal bore 34 in the packer, using seal 36.

Not shown in the drawings is the wireline support for the setting tool S which allows the proper positioning of the packer in the wellbore. The setting tool S is actuated in known ways to create differential movement between sleeves 24 and 26 such that sleeve 24 moves downwardly, while sleeve 26 moves upwardly to accomplish the setting, as indicated by the arrows in FIG. 2*a*. This differential movement cams the slips 10 outwardly, as shown in FIG. 2*c*. Continued differential movement brings rings 16 and 18 closer together, while the lock ring 22, using ratcheting teeth 23, retains the position of all the components, as shown in FIG. 2*c*. Shear pin 30 is sheared after full setting force is applied. This allows the setting tool S to be removed. At this point, the setting tool S can be removed and the production tubing run in the hole, coupled with a washover shoe 38 (see FIG. 3*a*). The washover shoe 38 has a J-slot arrangement 40 which latches onto lug 42, which is part of the mandrel assembly 28. It can also be secured by other means. Seals 44 effectively seal between the washover shoe 38 and the mandrel 28. Once that task is accomplished, the blanking plug 32 is removed by wireline.

It should be noted that the production tubing 46 supports the washover shoe 38 until the J-slot 40 catches the lug 42. At that time, the production tubing string 46 is sealingly engaged to the mandrel 28 and, upon removal of the blanking plug 32, production through the packer P can commence in a known manner.

Figure 4A:
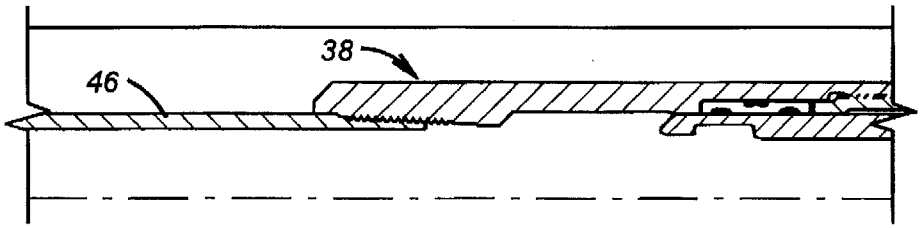
Figure 4B:
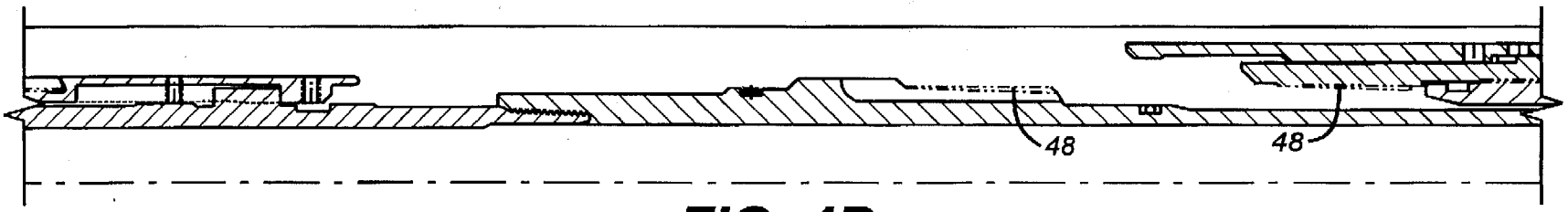

When it comes time to release the packer, FIGS. 4*a–d* illustrate one technique. In this technique, a rotational force is applied to the production tubing 46. This rotation undoes thread 48, which is shown in FIG. 4*b* already separated. With thread 48 undone, an upward force is applied on the production tubing 46, bringing up mandrel 28. Packer mandrel 29 is retained in a fixed position due to mating teeth 72 and 74. At its lower end 52, mandrel segment or sleeve 28 has a lug 54 which is secured to sleeve 50 by shear pin 56. Below lug 54 is ring 58, which is connected to sleeve 28 at thread 60.

Figure 3C:
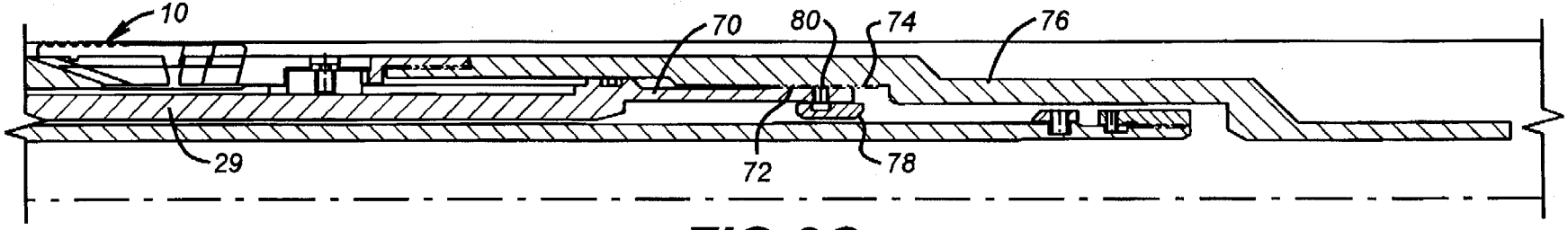

As shown in FIG. 3*c*, the set position of the slips 10 and sealing elements 12 is also retained by collet fingers 70, which have teeth 72 which engage teeth 74 on bottom sub 76. The position of the fingers 70 is secured by a ring 78 which is secured to the fingers 70 by a shear pin 80. Those skilled in the art will appreciate that a multiplicity of fingers 70, each with teeth 72, are employed, all of which engage the teeth 74 on the bottom sub 76.

Figure 4C:
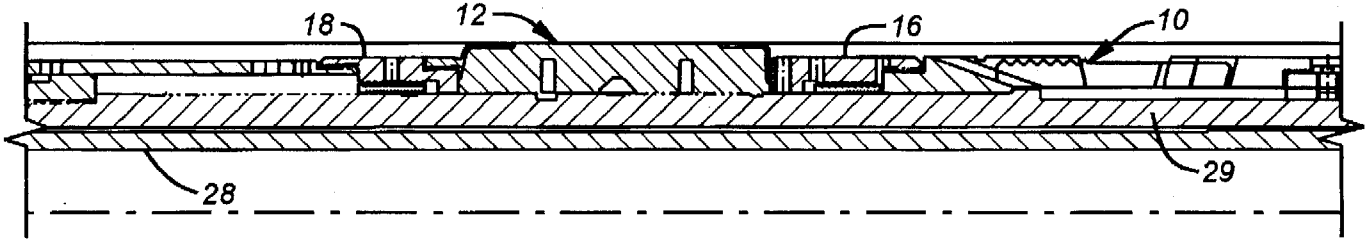
Figure 4D:
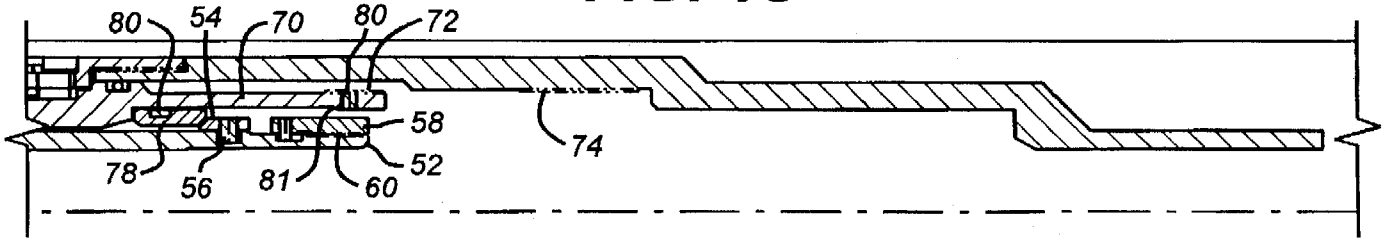

Referring now to FIG. 4*d*, it can be seen that after the thread 48 is undone and an upward pull is applied to the tubing string 46, lug 54 bears on ring 78 to ultimately break shear pin 80. When shear pin 80 breaks, the ring 78 can move upwardly, thus allowing the fingers 70 to flex radially inwardly so as to allow the teeth 72 to separate from the teeth 74. When this occurs, the assembly that holds the slips 10 and the sealing element 12 in a compressed state can be extended by continuing the upward pull on the production string 46.

Ultimately, as shown in FIG. 4*c*, the slips 10 ride down the tapered surface 14 and are retracted. A continuing upward pull on the production string 46 will move ring 18 away from ring 16 to allow the sealing elements 12 to relax to the position shown in FIG. 1*c*. As shown in FIG. 4*c*, the fingers 70 have had their teeth 72 move completely away from the interengaging teeth 74 as a result of the breaking of shear pin 80. Lug 54 then supports ring 78 when there is further upward pulling on the production string 46. Ring 78 is shaped so that it cannot fall off of fingers 70, even after shear pin 80 is broken because it catches shoulder 81. With lug 54 in contact with ring 78, the entire weight of the packer shifts to the production string 46 and it can then be removed, assuming that no complications develop.

However, especially for packers that have been in the wellbore for many years, the motions previously described may not be sufficient to release the packer from the wellbore. Thus, despite the undoing of thread 48 and the exertion of an upward force within the limits of the tensile loads which can be applied through the production tubing 46, the assembly for a multiplicity of reasons just fails to give way to allow the slips 10 or the sealing elements 12 to relax.

If this should occur, the apparatus of the present invention has a backup method of removal of the packer, which is illustrated in FIGS. 5*a–d* through 7*a–d*.

Figure 5A:
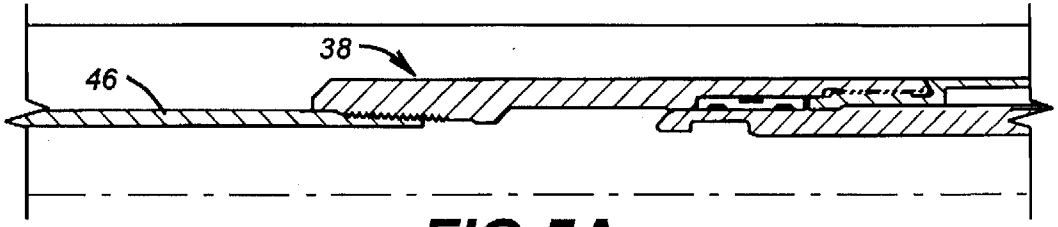
Figure 5B:
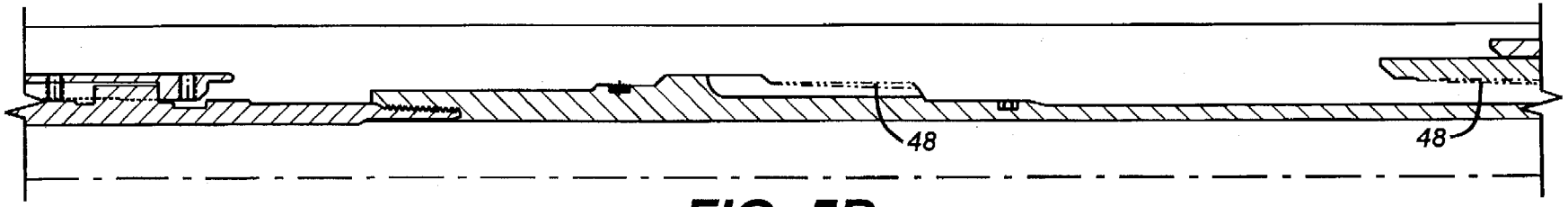
Figure 5C:
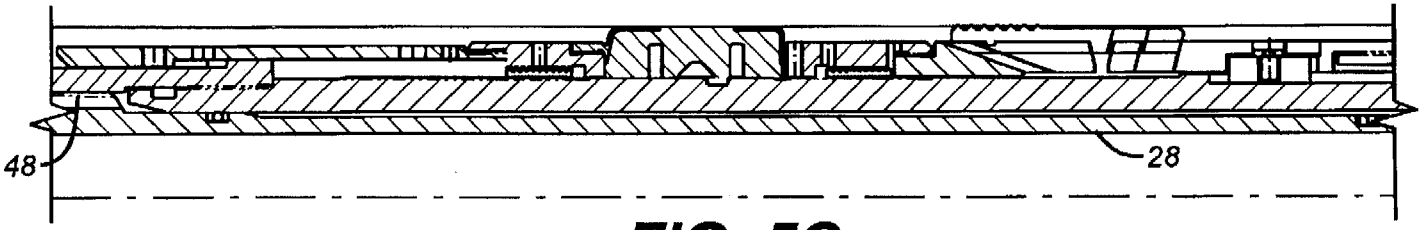
Figure 5D:
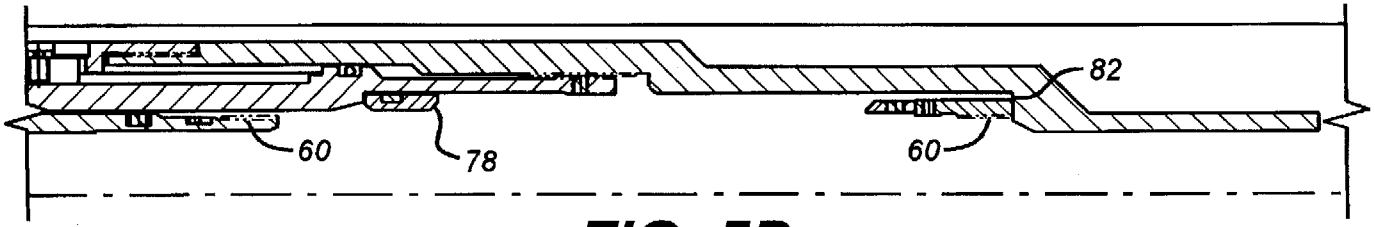

FIG. 5*b* shows thread 48 undone after rotation of the washover shoe 38, as previously described. Now, since the packer will not release, further rotation occurs from the position shown in FIG. 4*d*. The lug 54 can be released with respect to the sleeve 28 by breaking the shear pin 56 if it has not already been broken. The tubing string 46 is then rotated to undo thread 60. This leaves ring 58, as well as lug 54, resting on shoulder 82, as shown in FIG. 5*d*. With thread 60 now separated as shown in FIG. 5*d*, the production tubing 46 can be pulled out of the hole, taking with it the assembly comprising the washover shoe 38 as well as the sleeve 28.

Figure 7A:
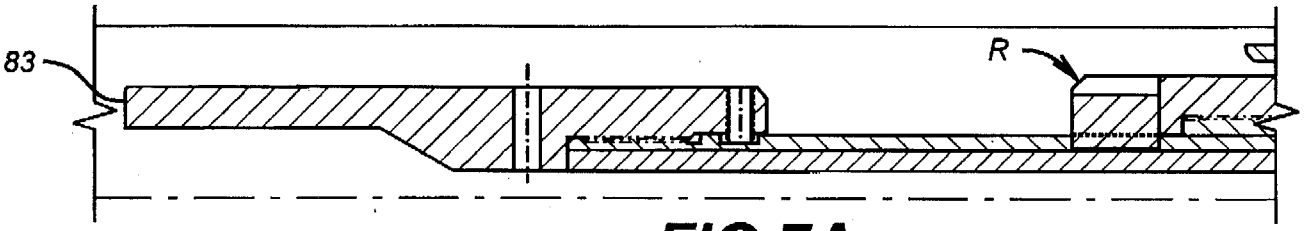
Figure 7B:
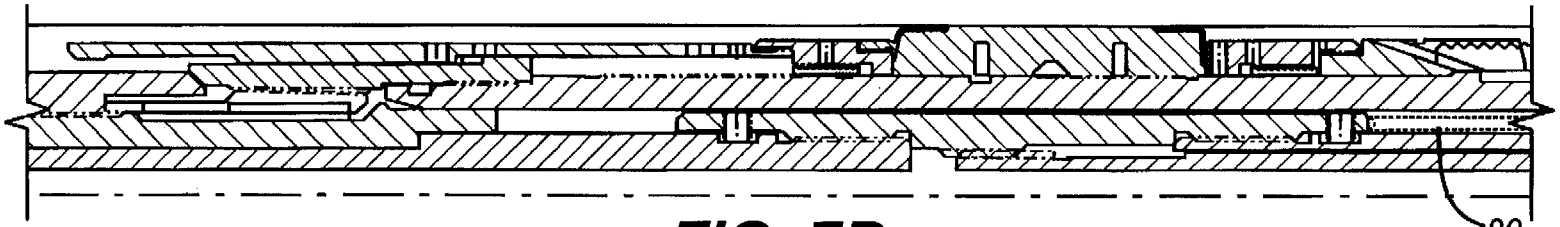
Figure 7C:
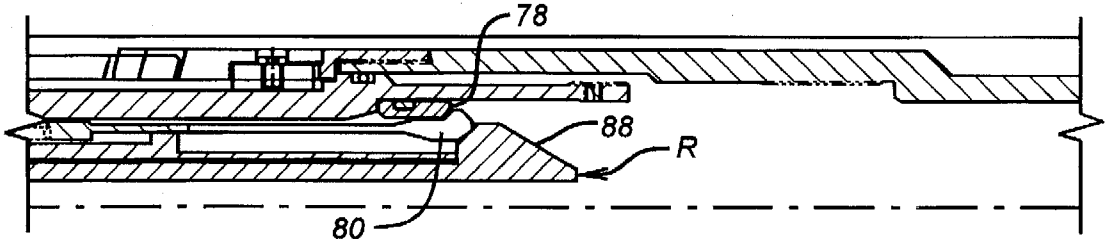
Figure 7D:
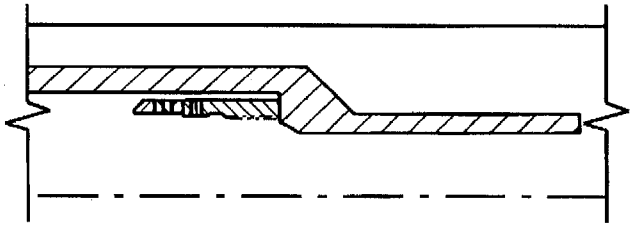

This having been accomplished, heavy-wall tubing 83, with or without jars, can be made up at the surface and run into the hole on top of a known release tool R, as illustrated in FIGS. 7*b–c*. At this point in time, the ring 78 is engaged by the release tool R, as shown in FIG. 7*c*. Now, with the heavy-wall tubing 83 in place and jars, if desired, in place, further efforts applying an even greater force can be made to release the packer and retrieve it from the wellbore.

Figure 6A:
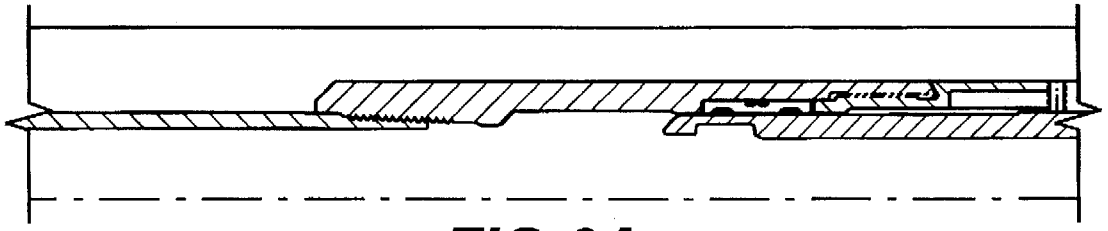
Figure 6B:
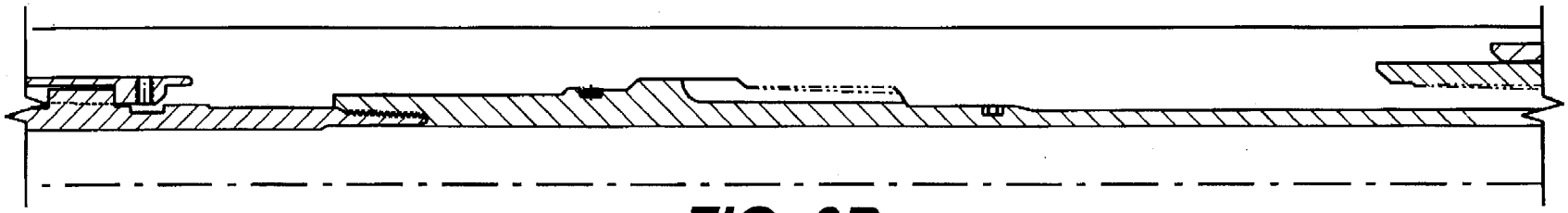
Figure 6C:
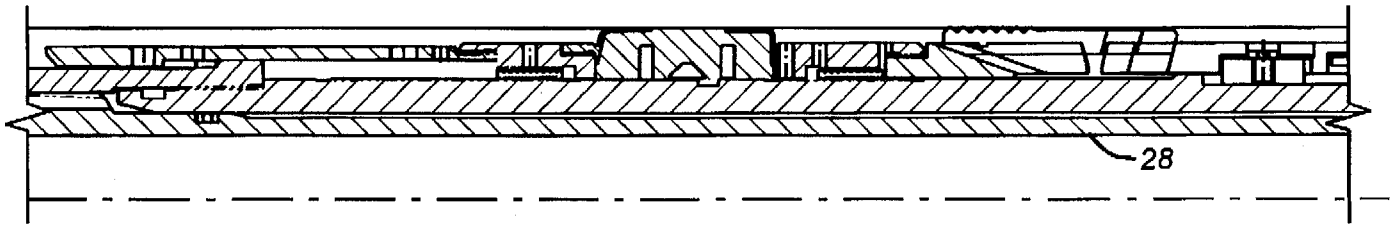
Figure 6D:
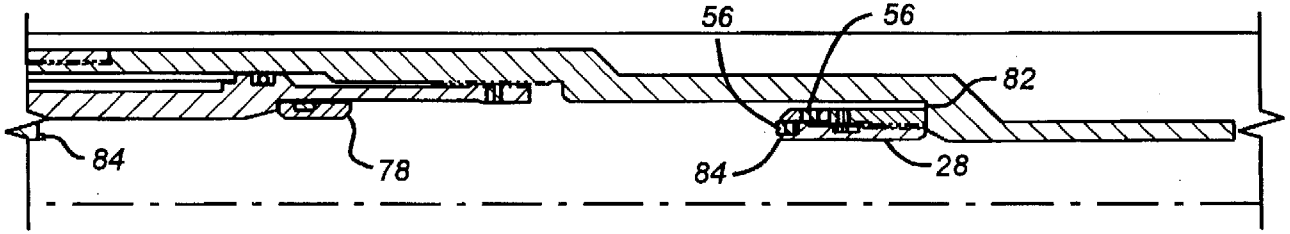

FIGS. 6*a–d* illustrate yet another way of removing sleeve 28 from the wellbore so as to expose the ring 78 for ultimate engagement with the release tool R. In FIG. 6*c–d*, the sleeve 28 actually shears in two pieces, leaving behind a piece 28' resting on shoulder 82. The sleeve 28 is designed to have a weak section 84 which, prior to deliberate failure, is connected to weak section 84' such that upon an upward force on the production tubing 46, a break occurs between segments 84 and 84', as shown in FIG. 6*d*. In this alternative design, shear pin 56 breaks first and the connection between weak sections 84 and 84' fails after the shear pin breaks, with the result that the segment 28' merely falls downwardly until it is caught by shoulder 82. Even in this embodiment, ring 52 can still be rotated off before shearing 84 from 84'.

Regardless of which technique is used as between the twist-off technique shown in FIG. 5*d* or the shear technique in FIG. 6*d*, the final step is to run in the hole with the retrieving tool R, which has a series of collets 86 supported by a body 88. The collets 86 are spring-loaded using a spring or springs 90. The collets 86 are deflected against the spring 90 and flex toward the body 88 to get past the ring 78. After passing the ring 78, the assembly is picked up and the collets 86 are trapped against body 88 as shown in FIG. 7*c*. Upward pulling on the heavy-wall tubing or use of the jar combined with upward pulling ultimately results in the retrieval of the packer.

Those skilled in the art can readily see that a packer design has been provided which allows for release with the production tubing without an extra trip into the wellbore. However, if the release technique using the production tubing 46 proves ineffective to liberate the packer from the wellbore, a backup release technique is provided. The production tubing 46 must be removed from the wellbore. However, such removal effectively takes with it sufficient components so as to expose the lug or ring 78 so that on a second trip with heavy-wall tubing and/or jar equipment, the lug 78 can be accessed for even greater applied forces than could be applied using the production tubing 46. While a second trip into the wellbore is required if the production tubing 46 does not dislodge the packer, operators can have greater confidence in the removability of their packers by knowing that a backup technique for removal of the packer exists. Thus, expensive and time-consuming milling operations can be avoided since the backup technique allows the application of substantially greater extraction forces than could be applied using the production tubing 46.

The foregoing disclosure and description of the invention are illustrative and explanatory thereof, and various changes in the size, shape and materials, as well as in the details of the illustrated construction, may be made without departing from the spirit of the invention.

We claim:

1. A method of setting and releasing a packer downhole, comprising:

running in a packer to a desired depth;

setting at least one slip;

setting at least one sealing element;

locking the set of said sealing element with a locking assembly;

attaching production tubing to the packer;

moving a mandrel in the packer with said production tubing;

providing a first mode of release as a result of shifting said mandrel which unlocks said locking assembly;

removing said production tubing;

providing access to said locking assembly by said removal of said production tubing; and defeating said locking assembly by alternate means as a second mode of release for the packer.

2. The method of claim 1, wherein providing said second mode of release further comprises:

removing said production tubing with sufficient portions of said mandrel to provide access to said locking assembly;

reengaging said locking assembly with a release tool supported by more rigid tubing than said production tubing; and defeating said locking assembly for removal of the packer.

3. The method of claim 2, further comprising:

providing at least one locking collet on said mandrel as a part of said locking assembly securing said mandrel to the packer body to hold the set of said slip and sealing element; and providing a lock ring to selectively secure said collet to the packer body.

4. The method of claim 3, further comprising:

disconnecting at least a portion of said mandrel from said packer body while said disconnected portion of said mandrel is supported by said production tubing;

engaging said lock ring with said disconnected portion of said mandrel; and attempting to move said lock ring and the remaining portions of said mandrel to secure the release of the packer with said production tubing.

5. The method of claim 4, further comprising:

providing a detachable abutment on said disconnected portion of mandrel to engage said lock ring;

selectively releasing said abutment if a predetermined force on said production tubing has failed to release the packer; and removing said mandrel which clears past said lock ring as a result of releasing said abutment.

6. The method of claim 5, further comprising:

releasing said abutment by rotation of said mandrel.

7. The method of claim 5, further comprising:

releasing said abutment by shearing off a portion of said mandrel supporting said abutment.

8. The method of claim 5, further comprising:

engaging said lock ring with said release tool after failing to secure removal of the packer with said abutment on said mandrel.

9. A releasable packer for use in a wellbore, comprising:

a body;

at least one slip on said body;

at least one sealing element on said body;

a mandrel selectively movable with respect to said body;

a locking assembly to secure at least a first portion of said mandrel to said body for securing the setting of the slip and sealing element;

the remaining second portion of said mandrel movable to selectively engage said locking assembly for defeat thereof as a first mode of release of the packer; and said second portion of said mandrel removable from said body to allow insertion of a release tool to engage said locking assembly as a second mode of release in the event a force of a predetermined value on said second portion of said mandrel fails to release the packer.

10. The packer of claim 9, wherein:

said locking assembly further comprises at least one collet on said first portion of said mandrel and a lock ring to secure a locked position of said collet; and said first and second portions of said mandrel movable unitarily to secure said collet in a position where said slip and sealing element are secured in the wellbore.

11. The packer of claim 10, wherein:

said first portion of said mandrel remains fixed by said collet and said second portion movable after detachment for selective engagement with said lock ring;

whereupon application of a sufficient force to said lock ring through said second portion of said mandrel, said collet becomes unsupported and first mode of release can be achieved.

12. The packer of claim 11, wherein:

said second portion of said mandrel comprises an abutment selectively engageable with said lock ring, said abutment selectively detachable from said mandrel.

13. The packer of claim 12, wherein:

said abutment is detachable by rotating said second portion of said mandrel.

14. The packer of claim 12, wherein:

said abutment is detachable by shearing off said abutment from said second portion of said mandrel.

15. The packer of claim 12, wherein:

said mandrel, without said abutment, can clear past said lock ring for removal thereof from said body;

whereupon said lock ring is accessible by insertion of a removal tool as a second mode of releasing the packer.

16. The packer of claim 12, wherein:

said second portion of said mandrel is supported by a production tubing string;

whereupon if application of a predetermined force on said production string fails to secure release of the packer, said production string with said second portion of said mandrel less said abutment is removable from the wellbore.

17. The packer of claim 16, wherein:

said release tool is supported by a tubing string of a heavier wall than said production tubing to allow application of a greater extractive force through said lock ring than was possible with said production tubing.

* * * * *